US006244031B1

(12) United States Patent
Murakami et al.

(10) Patent No.: US 6,244,031 B1
(45) **Date of Patent: *Jun. 12, 2001**

(54) PROCESS FOR PRODUCTION OF A COMPOSITE TEXTURED YARN, WOVEN OR KNITTED FABRICS MADE THEREFROM

(75) Inventors: Kakuji Murakami; Tsugihiko Kai; Hideaki Kunisada, all of Shiga-ken (JP)

(73) Assignee: Toray Industries, Inc. (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/198,764

(22) Filed: Nov. 24, 1998

Related U.S. Application Data

(62) Division of application No. 08/712,273, filed on Sep. 11, 1996, now Pat. No. 6,074,751.

(30) Foreign Application Priority Data

Sep. 13, 1995 (JP) ..... 7-235169
Dec. 21, 1995 (JP) ..... 7-350549

(51) Int. Cl.[7] ..... D01H 7/46
(52) U.S. Cl. ..... 57/290; 57/284; 28/249
(58) Field of Search ..... 28/249, 243; 57/6, 57/282, 284, 290

(56) References Cited

U.S. PATENT DOCUMENTS

| | | | | |
|---|---|---|---|---|
| 3,091,510 | | 5/1963 | McCord et al. | 18/54 |
| 3,763,640 | * | 10/1973 | Nagel et al. | 57/284 |
| 4,164,836 | * | 8/1979 | Tanae et al. | 57/284 |
| 4,218,869 | * | 8/1980 | Newton | 57/290 |
| 4,246,747 | * | 1/1981 | Plunkett et al. | 57/282 |
| 4,307,566 | | 12/1981 | Murata et al. | 52/228 |
| 4,454,196 | | 6/1984 | Iohara et al. | 428/359 |
| 4,467,594 | * | 8/1984 | Eschenbach | 57/6 |
| 4,475,330 | | 10/1984 | Kimura et al. | 57/245 |
| 4,610,131 | * | 9/1986 | Eschenbach et al. | 57/6 |
| 4,661,404 | | 4/1987 | Black | 428/369 |
| 4,712,366 | | 12/1987 | Tsujimoto et al. | 57/245 |
| 4,736,578 | * | 4/1988 | Shaffer | 57/6 |
| 4,955,189 | | 9/1990 | Yanagihara et al. | 57/207 |
| 5,083,419 | * | 1/1992 | Greifeneder et al. | 57/6 |
| 5,364,701 | | 11/1994 | Boles et al. | 428/373 |
| 5,379,501 | * | 1/1995 | Goineau | 57/6 |
| 5,802,836 | * | 9/1998 | Curran et al. | 57/290 |

FOREIGN PATENT DOCUMENTS

| | | | |
|---|---|---|---|
| 841230 | | 7/1960 | (GB) . |
| 79-05001 | | 12/1978 | (JP) . |
| 4-091243 | | 3/1992 | (JP) . |
| 6-57562 | | 3/1994 | (JP) . |
| 6-212522 | | 8/1994 | (JP) . |
| 7-189065 | | 7/1995 | (JP) . |
| 7-229027 | | 8/1995 | (JP) . |
| 565957 | * | 7/1977 | (SU) . |
| 709728 | * | 1/1980 | (SU) . |

* cited by examiner

*Primary Examiner*—William Stryjewski
(74) *Attorney, Agent, or Firm*—Austin R. Miller

(57) ABSTRACT

A composite textured yarn contains a component yarn A and a component yarn B each false twisted and crimped. The component yarn B is shorter in yarn length or larger in shrinkage at least after heat treatment. Single fibers of component B have thick portions and thin portions successively alternating in the longitudinal direction.

5 Claims, 8 Drawing Sheets

(3 of 8 Drawing Sheet(s) Filed in Color)

PROCESS FOR PRODUCTION OF A COMPOSITE TEXTURED YARN, WOVEN OR KNITTED FABRICS MADE THEREFROM

This Application is a Division of U.S. application Ser. No. 08/712,273, filed Sep. 11, 1996, now U.S. Pat. No. 6,074,751.

BACKGROUND OF THE INVENTION

1. Field of the Invention

The present invention relates to a composite textured yarn consisting of component yarns that have respective shrinkages that are different from one another, more particularly, a composite textured yarn favorable for obtaining a soft, and highly tensile, firm and resilient fabric.

A composite textured yarn having a core-sheath structure obtained by feeding together and false twisting two yarns that are different from one another in elongation is well known. This method can provide a highly crimped and highly bulky composite textured yarn with a core-sheath two-layer structure consisting of a component yarn lower in elongation as the core and another component yarn higher in elongation as the sheath, and the composite textured yarn is used as a material for worsted-like woven and knitted fabrics for general purposes.

2. Related Art

On the other hand, JP-A-06-057562 discloses a process for producing a composite textured yarn having excellent bulk and softness by crimping a component yarn (B) fed at a faster feed rate around another component yarn (A) fed at a slower feed rate, at a position between a false twisting heater and a spindle.

However, these conventional processes have problems in that since the composite textured yarn is highly crimped and highly bulky, glitter detrimental to fabric appearance, softness and to the aesthetic feel of the fabric occurs, and in that the thermal insulation performance important for the feeling or wearers of autumn and winter clothes is insufficient. These problems are solved by additional twisting in the case of the former process, and by using a yarn that is polygonal in cross section in the case of the latter process. However, these processes are not regarded as satisfactory enough, and no fabric having a sufficiently good fabric feeling having regard to tension, firmness, resilience, and thermal insulation performance, especially as compared with wool fabrics, has been obtained hitherto.

SUMMARY OF THE INVENTION

The present invention addresses the problem of solving the above mentioned disadvantages of the prior art, so as to provide woven and knitted fabrics having excellent softness and which nevertheless are highly tensile, firm and resilient.

According to one aspect, the present invention provides a composite textured yarn which comprises at least a component yarn A and a component yarn B each false twisted and crimped, the component yarn B having a length shorter than or, at least when subjected to heat treatment a shrinkage greater than, the length or shrinkage respectively of the component yarn A; and single fibers of the component yarn B, at least after heat treatment, having, arranged longitudinally of each said single fiber of component yarn B, successively alternating thick and thin portions of the said fiber.

According to another aspect, the invention provides a woven or knitted fabric comprising such a composite textured yarn.

According to a further aspect, the invention provides a process for producing a composite textured yarn, which process comprises the steps of bringing together at least two component yarns A and B and feeding to a false twister and thereby false twisting, the component yarns A and B, characterized in that, when brought together, the component yarns A and B are at respective temperatures different from one another.

According to a still further aspect, the invention provides an apparatus for producing a composite textured yarn comprising at least two yarn components A and B, which apparatus comprises means for controlling the temperature of at least one of the yarn components A and B such that the yarn components A and B are at respective temperatures different from one another, guide means for bringing together each of yarns A and B when at different respective temperatures, means for feeding the component yarns A and B to a false twister and a false twister for false twisting the component yarns A and B.

BRIEF DESCRIPTION OF THE DRAWINGS

Composite textured yarns embodying the present invention and processes and apparatus for producing them are described below in detail with reference to the accompanying drawings in which.

This application contains at least one drawing executed in color.

DESCRIPTION OF THE PREFERRED EMBODIMENTS

The composite textured yarn of the present invention contains a component yarn A and a component yarn B each false twisted and crimped.

In the present invention, the component yarns are false twisted and crimped. If they are not false twisted or crimped, and fabric becomes less bulky and less voluminous, so that disadvantageously fabrics prepared from such yarns look like paper.

Furthermore, in the present invention, the false twisted and crimped component yarns A and B are different at least in yarn length or shrinkage. If they are not different in yarn length or shrinkage, it is difficult to form a conjugated core-sheath two-layer structure consisting of a core formed by the component yarn larger in shrinkage and a sheath formed by the component yarn smaller in shrinkage in any subsequent step, for example, scouring before dyeing, or heat treatment such as thermal setting. In the present invention, by selectively using component yarns destined to be a core component and a sheath component, to meet each object or application, a desired fabric can be obtained.

Moreover, for improved fabric feeling resulting from increasing the voluminousness of the fabric and thereby preventing the fabric from becoming coarse and hard, the difference in shrinkage in boiling water is preferably 5 to 85%.

If the difference in shrinkage in boiling water is less than 5%, voluminousness is insufficient, and there is a tendency that such effects as tension, firmness and resilience cannot be manifested. If more than 85%, the gray fabric width must be widened, and this limits the choice of loom which can be adopted. The difference in shrinkage in boiling water is more preferably 5 to 60%.

The shrinkage in boiling water of the composite textured yarn is preferably 10 to 90%, having regard to tension, firmness, resilience and the beautiful silhouette available in a sewn garment.

However, since the difference in shrinkage alone cannot be a sole means of obtaining a fabric with a good enough feeling, the component yarn B which is higher in shrinkage and is used as the core of the composite textured yarn has thick and thin portions intermittently longitudinally spaced at least in the axial direction of the composite yarn, and it is also preferably that swollen portions are present in the fibers of the yarn B, which may resemble lumpy thick portions or indentations extending laterally across the fibres, which may resemble streaky dents in the yarn. Furthermore, it is preferable that at least some of the single fibers constituting the component B are internally distorted, and such a fine structure can have the very small gaps capable of producing a highly resilient feeling, formed along the component single fibers.

The internal distortion of the single fibers can be confirmed by the existence of interference fringes observed under crossed nicols using a polarization microscope.

Figure 1:
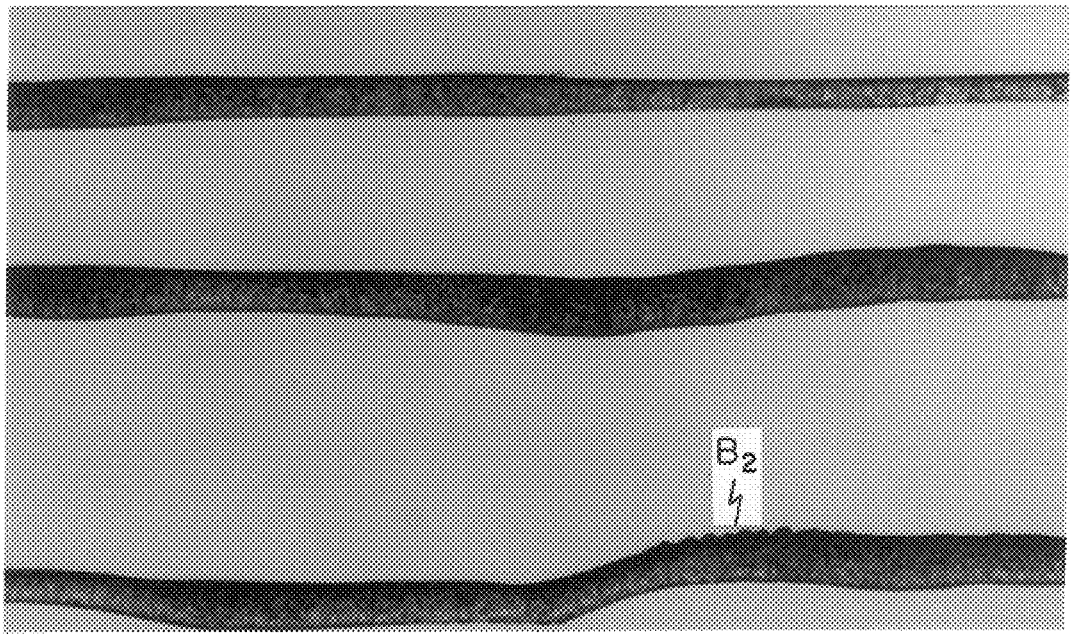
FIG. 1 is a schematic drawing showing an example of the construction of a component yarn B in a composite textured yarn embodying the present invention.
Figure 2:
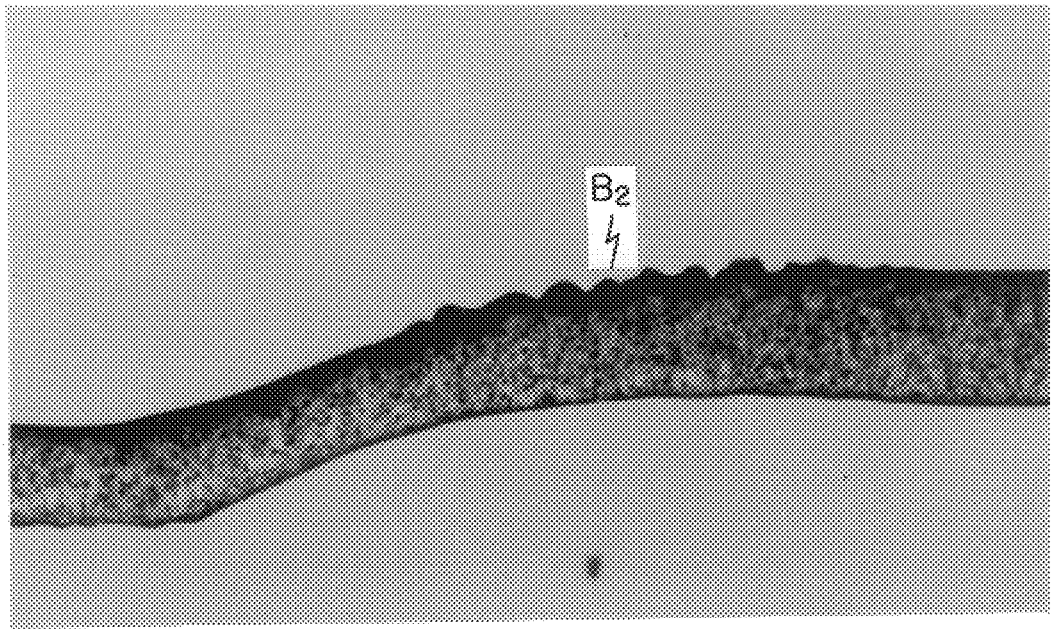
FIG. 2 is a schematic drawing showing in more detail the construction of a component yarn B in a composite textured yarn embodying the present invention having streaky dents.

In the yarns embodying the present invention shown in FIGS. 1 and 2, the lumpy thick portions and the streaky dents are referred to as $B_1$ and $B_2$ respectively.

The peculiar structure of these single fibers does not appear so clearly in the false twisted yarn, but is revealed by heat treatment, etc. in subsequent steps. In general, in the dyeing and finishing process of a woven or knitted fabric, the fabric is heat-treated by dry heat or wet heat of scouring, setting, dyeing, etc., and such heat treatment after formation as a fabric reveals the peculiar structure, by forming very slight gaps among the single fibers of the component yarn, and by displacing them, to provide tension, firmness and resilience. Furthermore, when the thick and thin portions are revealed, shrinkage behavior accompanying structural change and deformation occurs to cause the formation of very small gaps and displacement at least between the component yarns, or among the single fibers, or in the texture of the fabric, for further improving the fabric feeling. Moreover, the synergism with the core-sheath structure formed due to the difference in shrinkage between the component yarns can further enhance the fabric feeling.

In addition, the dents provide streaky forms almost equal to the single fiber diameter, and the fine streak forms can improve the glitter generated in the false twisted yarn due to the peculiar sectional deformation.

Composite textured yarn embodying the present invention also preferably has portions longitudinally adjacent to one another that have respective lengths, independently of one another, of from 0.2 to 20 mm, each such portion having a birefringence that is different from that of each portion longitudinally adjacent thereto. Thus the birefringence of the fibers may change substantially cyclically at 0.2 to 20 mm intervals. If the intervals of birefringence are less than 0.2 mm or more than 20 mm, the fabric formed by weaving or knitting the composite textured yarn may not have a sufficient number of gaps between the fibers, and may not have the particularly high resilience otherwise obtainable as a result of the present invention. More preferably, the intervals of birefringence are 0.3 to 12 mm.

The proportional amounts of component yarns A and B in a composite textured yarn of the present invention are preferably such as to provide a weight ratio of component yarns A:B of 10:90 to 90:10, in which case desirable properties similar to those of worsted, i.e., the thermal insulation performance and softness due to the gaps among the fibers, tension, firmness and resilience, can be obtained. Moreover, yarn breakage can be minimized so as to improve the operation convenience during the production of the composite textured yarn. The ratio is more preferably 30:70 to 70:30 for particular improvement in operation convenience.

In the composite textured yarn of the present invention, to exhibit strong tension, firmness and resilience inside the woven or knitted fabric, and to exhibit a soft fabric feeling on the surface of the woven or knitted fabric, it is preferably that the average fineness of the single fibers constituting the component yarn B is larger than the average fineness of the single fibers constituting the component yarn A, and that the total fineness of the component yarn B is larger than the total fineness of the component yarn A.

Figure 3:
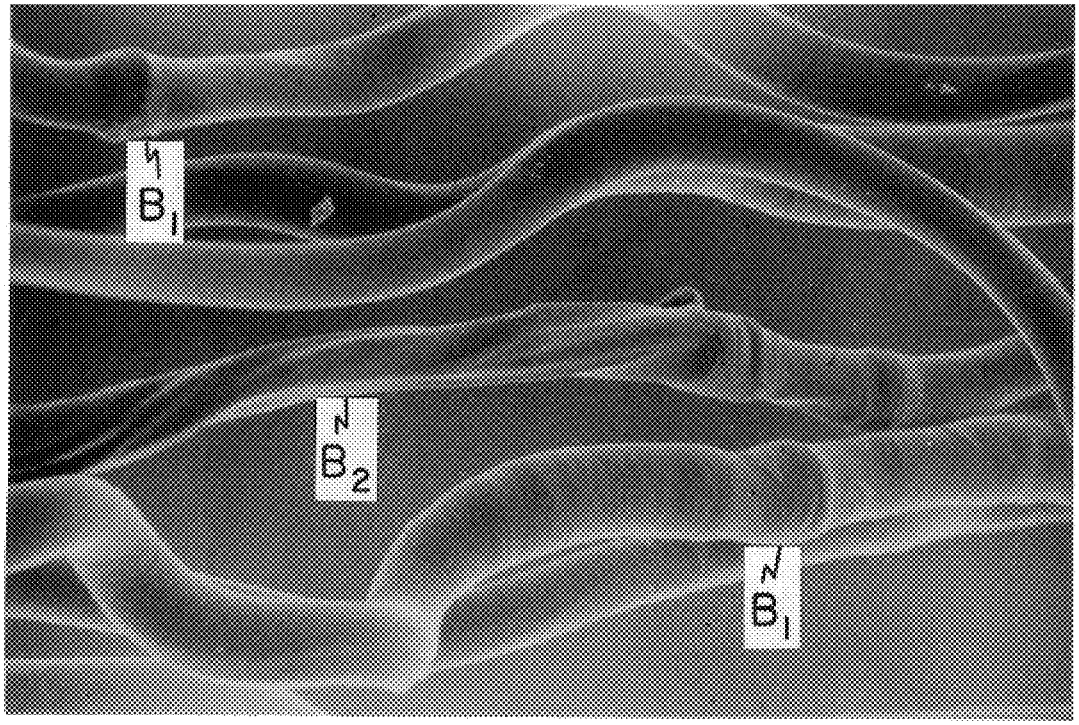
FIG. 3 is a schematic drawing showing a further example of a construction of a component yarn B in a composite textured yarn embodying the present invention.

FIGS. 1 to 3 are microscopic photos showing examples of constructions of a component yarn B of a composite textured yarn embodying the present invention after heat treatment.

In FIG. 1, the single fibers of the component yarn B have thick and thin portions successively alternately appearing in the axial direction. The alternately appearing thick and thin portions cannot be clearly seen in the false twisted yarn, but are revealed by later heat treatment. The portions smaller in heat shrinkage do not change so much, while the portions larger in heat shrinkage change to be thicker. In other words, the difference in shrinkage is revealed to form the thick and thin portions.

It is also preferable that streaky dents exist only in some of single fibers. Furthermore, it is also preferable that the dents are formed by the component yarn A in the false twisting step. FIG. 2 is an expanded view showing the streaky dents $B_2$ of FIG. 1.

In FIG. 3, the single fibers of the component yarn B also have lumpy think portions $B_1$ and streaky dents $B_2$ in addition to the thick and thin portions successively alternately appearing in the axial direction.

It is preferable that the composite textured yarn of the present invention contains single fibers very finely characteristically deformed as shown in FIGS. 1 to 3, since the deformation can be further revealed by the heat treatment in the dyeing and finishing process.

As described above, a composite textured yarn embodying the present invention may show substantially two-dimensionally gentle wavy crimps without showing compact and intricate three-dimensional crimps. In addition single fibers thereof may also have thick and fine portions alternately appearing at short intervals in the axial direction and have regions in which streaky dents extending in the radial direction almost equal to the diameter of single fibers appear.

The composite textured yarn of the present invention preferably shows spontaneously elongating behavior if the heat treatment conditions after false twisting are properly selected, and in this case, in addition to the above mentioned features due to shrinkage, the spontaneous elongation causes the formation of gaps and displacement at least between the component yarns, or among the single fibers or in the texture of the fabric, to further contribute to the improvement of fabric feeling. The composite textured yarn of the present invention preferably has a spontaneous elongation of 0.2 to 25% under heat treatment. Furthermore, for pressure relieving by the component yarn B to allow softness to be expressed by the component yarn A, the component yarn B preferably has a spontaneous elongation of 0.2 to 25%.

Moreover, the sectional deformation caused in the false twisting step is further transformed to restore the original sectional form as the polymer structure is eased by later heat treatment, for decreasing the sharp portions peculiar to the false twisted yarn, hence decreasing glitter, to exhibit a mild luster.

In the present invention, the % crimp rigidity of the composite textured yarn is preferably 2 to 30%.

If the crimp rigidity is more than 30%, a crimped yarn with a compact three-dimensional structure is formed, to increase bulkiness and voluminousness, but the spongy-feeling peculiar to conventional composite textured yarn appears. Furthermore, tension and firmness are impaired by the crimps of the single fibers acting as three-dimensional obstacles, in a tendency to lower the fabric feeling and grade. Therefore, it is preferable to keep the crimp rigidity at 30% or less, more preferably 2 to 20%. In this case, gently wavy crimp formation like that of natural wool can be obtained to overcome the disadvantages of the conventional highly crimped yarn.

Furthermore, in the composite textured yarn of the present invention, if the component yarns A and B are different in yarn length, it is preferable that at least the two component yarns A and B are interlaced to better integrate the component yarns, and to disperse uniformly the yarns of different length in the axial direction for improving the surface grade of the woven or knitted fabric. The interlacing can improve the working convenience, handling convenience, processability, etc. in subsequent processing steps such as weaving or knitting.

The interlacing frequency is not especially limited, but it is preferably sufficiently frequent that the component yarns are not separated from each other, but without adversely affecting the fabric feeling and grade.

The at least two component yarns used in the present invention are preferably thermoplastic synthetic fibers. For example, polyamide fibers, polyester fibers, polyacrylonitrile fibers, polyvinyl alcohol fibers, polyvinyl chloride fibers, polyvinylidene chloride fibers, polypropylene fibers, polyethylene fibers or cellulose fibers, can be used. These fibers are not limited in sectional form, properties, etc. Furthermore, undrawn yarns, semi-drawn yarns, drawn yarns, etc. can be used in any desired combination, and moreover, mono-filament yarns and multi-filament yarns, etc. can also be used in any desired combination.

To obtain a delicate woven or knitted fabric with a sophisticated feeling, it is preferably that the composite textured yarn of the present invention has at least any of loops, snarls, slackened portions, or fluff, etc. formed due to the difference in respective yarn lengths.

The composite textured yarn of the present invention preferably has 40 or more projected fibers per meter. Here, by "projected fiber" we mean a fiber projecting 1 mm or more in length from the surface of the yarn, and can also take the form of a loop, snarl, slackened portion, fluff, etc. The projected fibers were measured at a yarn speed of 50 m/min under a tension of 0.1 g/d, using a fluff counter (Model DT-104 produced by Toray Engineering K.K.).

The composite textured yarn of the present invention can be controlled in shrinkage by heat treatment in any one of the steps subsequent to false twisting, and processed later by weaving or knitting, etc. Additionally or alternatively the heat treatment may be carried out subsequently to weaving or knitting.

A preferred process for preparing a composite textured yarn embodying the present invention is described below.

In the present invention, at least two component yarns must be used, but to characterize the composite textured yarn, it is also possible to use three or four component yarns, for example, for giving an antistatic effect or a grandrell-yarn like effect, etc.

Figure 4:
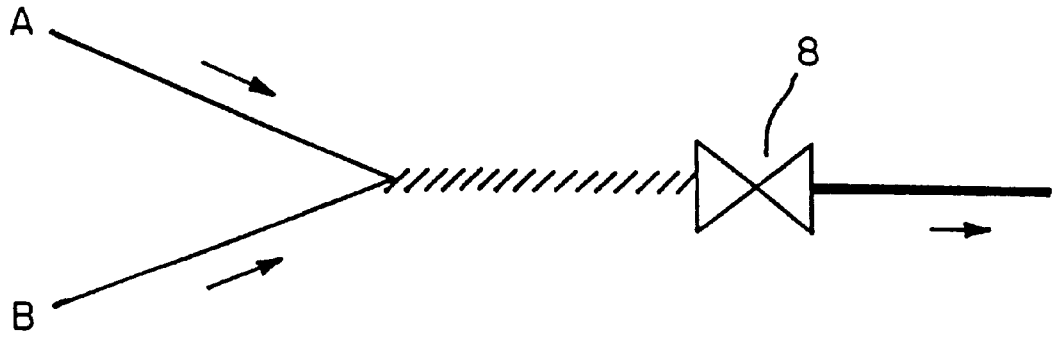
FIG. 4 is a schematic drawing typically showing the processing principle of a process embodying the present invention.

FIG. 4 is a schematic drawing typically showing the processing principle of a process embodying the present invention. A plurality of yarns are fed by a system for feeding them at the same or different speeds, and treated so as to provide component yarns A and B different in temperature. They are then joined and false twisted by the false twisting action of a false twisting rotor 8, to form from them a composite textured yarn.

Figure 5:
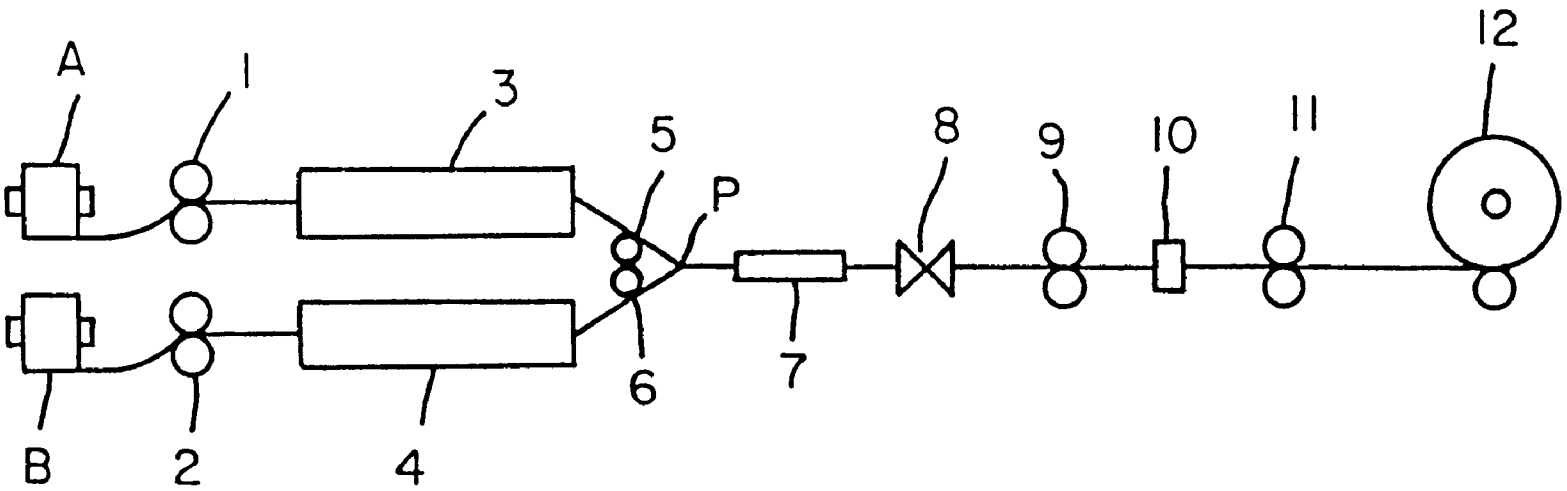
FIG. 5 is a schematic drawing typically showing an example of an apparatus suitable for producing a composite textured yarn of the present invention.
Figure 6:
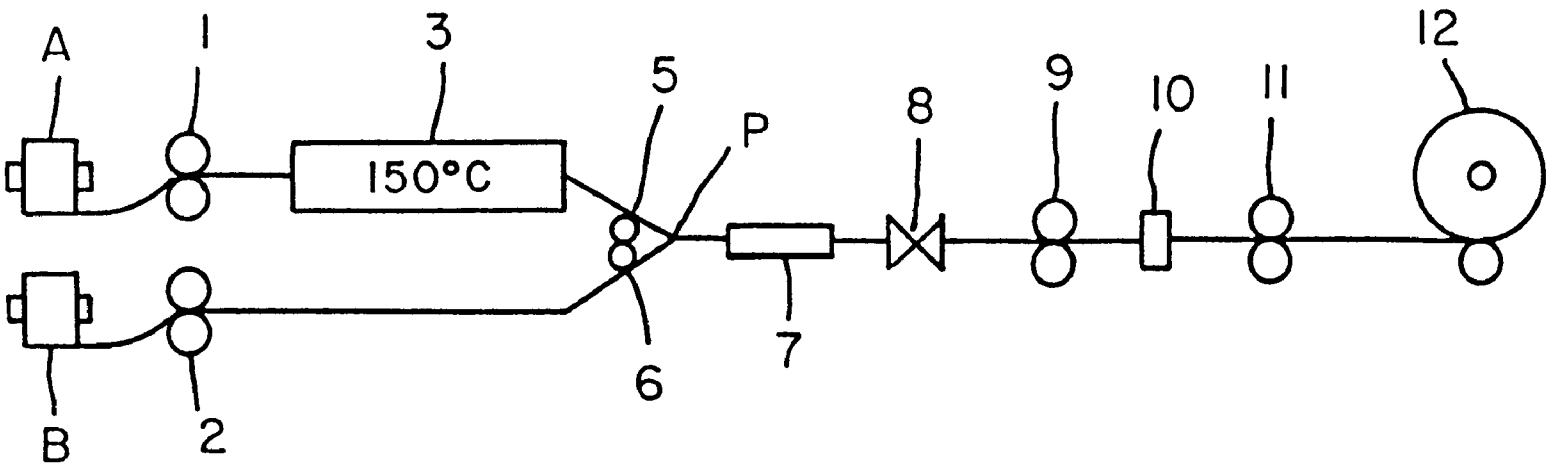
FIG. 6 is a schematic drawing typically showing another example of an apparatus suitable for producing a composite textured yarn embodying the present invention.

FIG. 5 is a schematic drawing typically showing an example of an apparatus suitable for producing a composite textured yarn embodying the present invention. In FIG. 5, a component yarn A and a component yarn B are fed separately to first rollers 1 and first rollers 2 respectively, then separately fed through respective hot plates 3 and 4 and, after being joined together, over a cooling plate 7 and through a false twisting rotor 8 respectively installed upstream of second rollers 9. The false twisted component yarns are then closely combined together by interlacing nozzles 10 disposed between the second rollers 9 and third rollers 11 and wound as a package 12 downstream of the third rollers 11. In this case, the first rollers 1 and the first rollers 2 can be rotated at the same speed or different speeds, being able to be set properly depending on the properties of the fed yarns and the stability of processing. It is important that the hot plates 3 and 4 are different in temperature. The temperature difference can be selected as desired. Of course, it can also be preferably practiced that one component yarn only is heated while the other one is not heated, i.e., that one hot plate is not heated or not used, to make the component yarns A and B different in temperature. Such an apparatus is shown in FIG. 6 which, in all other respects, is the same as FIG. 5.

Furthermore, the temperature of heater is preferably higher than the glass transition temperature of component yarn B.

The component yarns A and B different in temperature are guided by yarn path control members 5, 6 so as to unite at a joining point P. Thus, downstream of the joining point, the component yarn having the lower temperature is heated by the component yarn having higher temperature, so that the component yarns different in temperature give and receive heat to and from each other while they are false twisted.

In this heat treatment, the component yarn having the higher temperature heats the component yarn having the lower temperature by heat conduction, while the component yarn having the higher temperature is cooled by the component yarn having the lower temperature. As a result, the component yarn having the lower temperature is unevenly heat-treated in the radial direction of the yarn and/or in the axial direction of the yarn.

Such a process embodying the present invention allows the component yarn having the lower temperature to be heated unevenly in the axial direction because of the fiber migration due to twisting.

This heat treatment changes the internal structure within and between single fibers in the axial direction, and causes fiber and yarn deformation, to present thick and thin portions unevenly and frequently alternately appearing in the axial direction. The process may also be conducted so as to provide uneven portions, portions frequently alternately changing in shrinkage, lumpy thick portions, and dents providing streaks extending across the single fibers and component yarns, and substantially two-dimensional gentle wavy crimps different from the compact three-dimensional crimps obtained by the conventional false twisting step.

Moreover, in view of the physical properties of the fibers, the composite textured yarn changes in shrinkage and Young's modulus very frequently in the axial direction of single fibers. On the other hand in the radial direction, the tightening and pressing action due to twisting partially forms streaky dents almost equal to the diameter of single fibers, to give a characteristic composite textured yarn.

The composite textured yarn unevenly heat-treated in the axial direction within and between single fibers can be processed to exhibit frequent alternate changes in formation, shrinkage, crimps, etc., by any later heat treatment step, for example, by wet heat or dry heat treatment after weaving or knitting. Thus, a characteristic woven or knitted fabric can be obtained. The cooling plate 7 is provided to allow the structure achieved by false twisting to be efficiently cooled and fixed and to allow yarn passage control and vibration (surge) prevention during false twisting for stable processing. However, the cooling plate is not absolutely necessary.

To make the component yarns supplied in the present invention different in temperature, as shown in FIG. 2, only one of the component yarns can be heated while the other component yarn is supplied at room temperature, so that they may be different in temperature at the joining point, or both the component yarns can be heated, to be different in temperature at the joining point.

For heating, a dry hot plate or heating in a hollow tube, etc. as used for ordinary false twisting can be used, and any other heating means can also be used. Of course, the heating medium is not limited.

The false twisting rotor used in the present invention can be any of an external contact type friction false twister, a belt nip false twister, a spindle false twister, etc., appropriately selected in dependence upon processing conditions such as the component yarns used, processing speed, and count of false twist.

In the process for producing a composite textured yarn of the present invention, in order to improve the surface grade of the fabric obtained by weaving or knitting the composite textured yarn of the present invention, the false twisted component yarns are also preferably closely combined together.

For closely combining the component yarns together, fluid treatment nozzles or interlacing nozzles, etc. can be used, or furthermore, any other means such as regular twisting, alternate twisting, fusion bonding or adhesive bonding can also be used.

The component yarns used in the present invention can be drawn yarns and/or semi-drawn yarns and/or undrawn yarns. The component yarns used as the at least two component yarns A and B can also be different or the same in kind. Since it is intended to change the internal structure of fibers by heating, a thermoplastic polymer is preferable. For example, polyamide fibers, polyester fibers, polyacrylonitrile fibers, polyvinyl alcohol fibers, polyvinyl chloride fibers, polyvinylidene chloride fibers, polypropylene fibers, polyethylene fibers, cellulose fibers, etc. can be used. Of course, these fibers can be used irrespective of their form, for example, fineness, number of filaments, sectional form, dyeability, luster, twisted or not, etc., and furthermore irrespective of physical properties such as strength-elongation characteristics, shrinkage and Young's modulus.

The present invention uses at least two, but possibly more component yarns in combination. For example, when three component yarns are used in combination, all of them can be different in temperature, or two of them can be same in temperature while the other is higher or lower in temperature than the two yarns. Moreover, all the three component yarns can be made of respective different polymers, or can also be made of the same polymer.

A fabric to be produced by weaving or knitting a composite textured yarn embodying the present invention is described in more detail below.

Since the composite textured yarn embodying the present invention has the fine structure as described before, so as inevitably to have very small gaps among the single fibers, the fabric produced by weaving or knitting the composite textured yarn can be tensile, firm and resilient.

To allow the composite textured yarn of the present invention be roundish, to obtain a woven or knitted fabric with a harsh-feeling, and to improve processability, it is also preferable to additionally S-twist or Z-twist to provide 5 to 3000 twists/m.

An apparatus for producing a composite textured yarn embodying the present invention is described in more detail below.

Such as apparatus for producing a composite textured yarn embodying the present invention has yarn feeders for feeding two or more component yarns separately, a heater, a false twister, and a yarn path control member installed between the heater and the false twister.

At least one of the component yarns is fed through the heater. The component yarn which is fed through the heater and the component yarn which is not fed through any heater are joined by a yarn path control member, and guided into the false twister.

Specifically, for example, a component yarn which is fed through the heater is united with a component yarn which is not fed through any heater, and they are false twisted by the false twister downstream of the yarn path control member.

Figure 7:
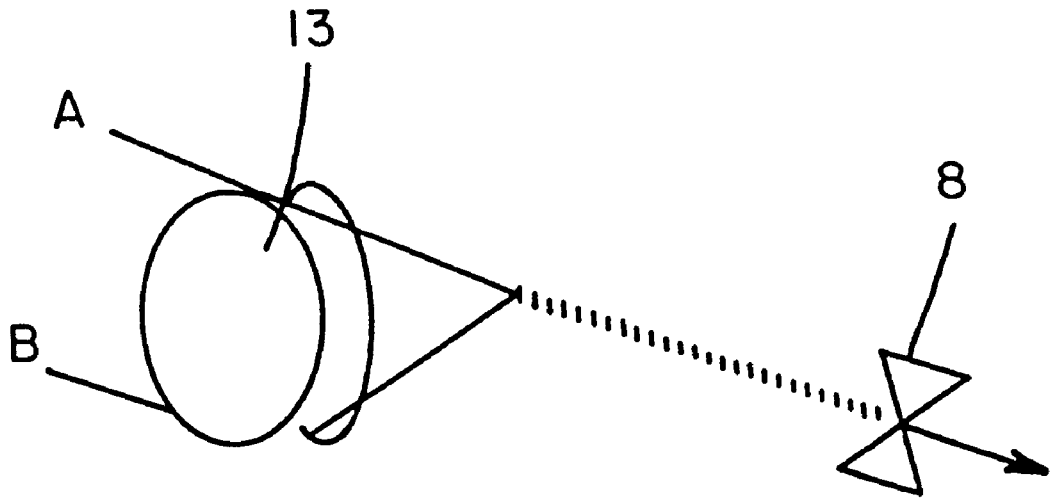
FIG. 7 is a schematic drawing typically showing a grooved guide used as an example of a joining point control member used in a process for producing a composite textured yarn embodying the present invention.
Figure 8:
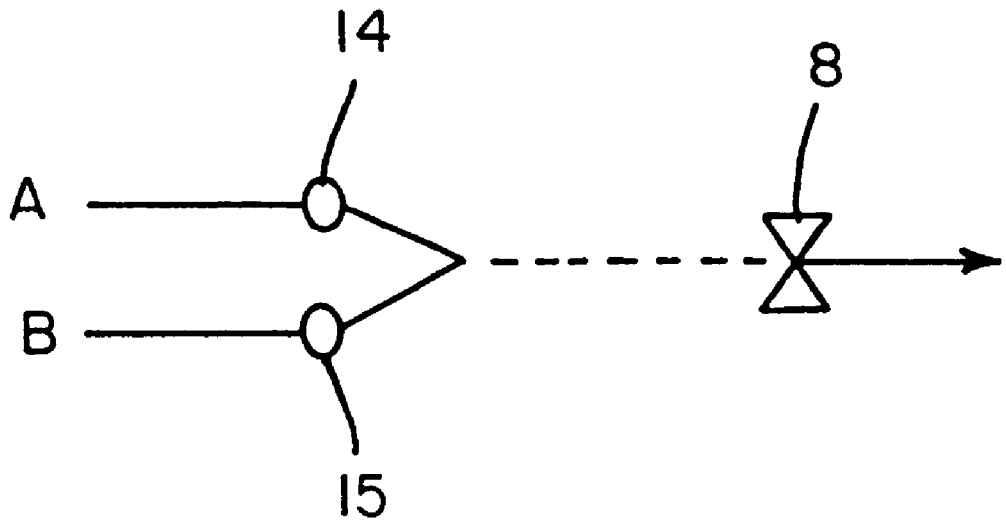
FIG. 8 is a schematic drawing typically showing pig tail guides as another example of a joining control member used in a process for producing a composite textured yarn embodying the present invention.

The yarn path control member can be a pair of rods as shown in FIGS. 5 and 6, or a metallic or ceramic grooved guide 13 as shown in FIG. 7, or pig tail guides 14 and 15 as shown in FIG. 8.

The yarn path control member can be used alone or in combination with additional yarn path control members, and the number of the control members is not limited.

Composite textured yarn embodying the present invention are not described in even more detail with reference to the following Examples. The values of shrinkage in boiling water, % crimp rigidity and spontaneous elongation given in the Examples were measured according to the following methods.

(1) Shrinkage in boiling water and % crimp rigidity

Measured according to JIS-L-1090.

(2) Spontaneous elongation

A load of 20 mg/d was suspended form a sample formed as a skein, and the sample was treated in water heated from room temperature to 98° C. (at a heating rate of 2° C./min), and air-dried for a whole day and night. The length $L_1$ of the sample at this moment was measured. Then, the sample was treated in a 180° C. oven for 5 minutes and cooled. The length $L_2$ of the sample at this moment was measured. The spontaneous elongation, as a % of the original length, was obtained from the following formula. In the above treatments and measurement, the load of 20 mg/d was kept suspended.

$$\text{Spontaneous elongation } \% = [(L_2 - L_1)/L_1] \times 100\%$$

EXAMPLE 1

Polyethylene terephthalate semi-dull polymer was melt-spun according to a conventional method, to produce a component yarn A (128 deniers), consisting of 72 filaments and with a breaking elongation of 180%, and a component yarn B (290 deniers), consisting of 30 filaments and with a breaking elongation of 200%. They were respectively semi-drawn, wound and false twisted to be conjugated using a process carried out by means of the apparatus of FIG. 6. With reference to FIG. 6, the first rollers 1 and 2 and the second rollers 9 were set at 205 m/min and 339 m/min respectively, and the hot plate 3 was set at 150° C., to heat the component yarn A. The component yarn B was arranged to run in air at room temperature. As the false twisting rotor 8, an external contact type friction false twister was used for false twisting and conjugating the component yarns, and the composite textured yarn was interlaced by the interlacing nozzles 10 installed between the rollers 9 and 11. Next, interlaced yarn was taken up.

The composite textured yarn obtained in this example had a core-sheath structure consisting of a highly crimped sheath component yarn and an only slightly crimped core component yarn made from the component yarns A and B different in shrinkage. Furthermore, the heat-treated component yarn B had a structure with thick and thin portions successively alternately appearing in the axial direction, and some monofilaments were distorted, and had lumpy thick portions and streaky dents, having portions where the birefringence changed substantially cyclically at intervals of 0.5–10.0 mm. The component yarn running between the joining point P and the false twisting rotor 8 was sampled to measure the false twist count at a load of 0.1 g/d (denier), which was found to be 1740 (turns/m).

The composite textured yarn of the present invention was then twisted so as to provide 500 turns/min, to be used as a weft (64 threads/inch in density), and a yarn of 75 deniers, consisting of 36 filaments and made of the same polymer was used as warp, for weaving a fabric. The fabric was dyed and finished according to a conventional method. The woven fabric obtained was soft, tensile, firm, resilient, and highly capable of thermally insulating, looking like worsted. Of course, the dyed fabric did not show any glitter and had a deep and restful hue.

Table 1 shows the properties of the composite textured yarn embodying the present invention thus produced and also shows the properties of the component yarns A and B sampled before interlacing, the respective values being measured separately.

TABLE 1

| Yarn Property | Component yarn A | Component yarn B | Composite textured yarn embodying the present invention |
|---|---|---|---|
| Shrinkage in boiling water (%) | 7.6 | 44.0 | 41.1 |
| Crimp rigidity (%) | 4.7 | 7.3 | 7.0 |
| Spontaneous elongation (%) | — | 5.5 | 5.0 |

EXAMPLE 2

A composite textured yarn was produced as described in Example 1, except that a drawn yarn (75 deniers) and consisting of 72 filaments was used as the component yarn A, and that the speed of the first rollers 1 was 339 m/min.

In an apparatus as shown in FIG. 6, between heater 7 and false twister rotor 8, an abrasive rod 5 mm in diameter and coated with No. 400-mesh artificial diamond was installed.

The composite textured yarn obtained in this example and the woven fabric obtained from it had spun-yarn like fluff and feeling, in addition to the features achieved in Example 1.

EXAMPLE 3

The composite textured yarn of the present invention used in Example 1 was used, for warp and weft, to produce plain woven fabrics having a warp density of 50 threads/inch and a weft density of 43 threads/inch under the four condition levels stated in Table 2. The woven fabrics were dyed and finished according to a conventional method, and their handle was evaluated. All the fabrics of levels 1 to 4 were highly tensile, firm and resilient. The fabrics of levels 1 and 2 had a woolly feeling, and those of levels 3 and 4 were like warp stripe-featured crepe, with an excellent fresh feeling. The dyed fabrics did not show any glitter and presented a deep and restful hue.

TABLE 2

| Level of additional twists | Number of additional twists of warp (turns/m) | Number of additional twists of weft (turns/m) |
|---|---|---|
| Level No. | | |
| Level 1 | S-twist 500*1 | 0 |
| Level 2 | S-twist 500*1 | S-twist 500*1 |
| Level 3 | S-twist 500*2 | S-twist 1000*2 |
| Level 4 | S-twist 500*1 | S-twist 1500*2 |

*1: Twists were not set after completion of additional twisting.
*2: Twists were set by 60° C. wet heat after completion of additional twisting.

As will be appreciated from the above, the present invention allows the production of woven or knitted fabrics favorably used for producing shirts, blouses, suits, jackets, blazers, pants, coats, trousers, uniforms, working wear, etc., exhibiting good tension properties, firmness, resilience, thermal insulation performance, etc. and being especially aesthetically pleasing in appearance and touch.

What is claimed is:

1. A process for producing a composite yarn, which process comprises the step of bringing together at least two components yarns A and B and feeding to a false twister and thereby false twisting, where the component yarns A and B, when brought together, are at respective temperatures different from one another and component yarn B is heated to a temperature higher than the glass transition temperature while they are false twisted.

2. A process according to claim 1, wherein the component yarn B is composed of thermoplastic synthetic fibers selected from the group consisting of semi-drawn fibers and undrawn fibers.

3. A process for producing a composite yarn, which process comprises the step of bringing together at least two component yarns A and B and feeding to a false twister and thereby false twisting, wherein the component yarns A and B when brought together are at respective temperatures different from one another and component yarn B is heated to a temperature higher than the glass transition temperature while they are false twisted, and wherein the component yarn B is composed of thermoplastic synthetic fibers selected from the group consisting of semi-drawn fibers and undrawn fibers.

4. A process according to claim 3, wherein the component yarn B, when brought together, is at a temperature lower than that of the component yarn A, and is heated unevenly in the axial direction thereof while they are false twisted.

5. A process according to claim 3, wherein the false twisting is carried out with an apparatus selected from the group consisting of an external contact type friction false twister, a belt nip false twister and a spindle false twister.

* * * * *